US005409219A

United States Patent [19]

Saksun, Sr.

[11] Patent Number: 5,409,219

[45] Date of Patent: Apr. 25, 1995

[54] WEIGHTED GOLF CLUB HEAD

[76] Inventor: John Saksun, Sr., 27 Blair Athol Crescent, Etobicoke, Ontario, Canada, M9A 1X6

[21] Appl. No.: 84,503

[22] Filed: Jul. 1, 1993

[51] Int. Cl.[6] ..... A63B 53/04

[52] U.S. Cl. ..... 273/79; 273/168; 273/167 F; 273/171

[58] Field of Search ..... 273/77 R, 164.1, 193 R, 273/194 R, 167 R-77 A, 79

[56] References Cited

U.S. PATENT DOCUMENTS

| | | | |
|---|---|---|---|
| 645,942 | 3/1900 | Cran . | |
| 690,940 | 1/1902 | Febiger | 273/170 |
| 1,318,325 | 10/1919 | Klin . | |
| 1,453,503 | 5/1923 | Holmes . | |
| 3,064,980 | 11/1962 | Steiner . | |
| 3,652,094 | 3/1972 | Glover . | |
| 3,845,960 | 11/1974 | Thompson . | |
| 3,966,210 | 6/1976 | Rozmus | 273/167 F X |
| 3,979,122 | 9/1976 | Belmont . | |
| 4,180,269 | 12/1979 | Thompson . | |
| 4,340,230 | 7/1982 | Churchward . | |
| 4,343,472 | 8/1982 | Hamilton | 273/171 X |
| 4,422,638 | 12/1983 | Tucker | 273/78 |
| 4,580,784 | 4/1986 | Brill | 273/164.1 X |
| 4,607,846 | 8/1986 | Perkins . | |
| 4,618,149 | 10/1986 | Maxel | 273/79 |
| 4,655,459 | 4/1987 | Antonious | 273/171 |
| 4,852,879 | 8/1989 | Collins | 273/169 X |
| 4,871,174 | 10/1989 | Kobayashi | 273/167 H X |
| 4,898,387 | 2/1990 | Finney | 273/167 F |
| 4,936,582 | 6/1990 | Bernstein | 273/78 X |
| 5,083,778 | 1/1992 | Douglass | 273/78 |
| 5,116,047 | 5/1992 | Phelan | 273/80.2 X |
| 5,253,869 | 10/1993 | Dingle | 273/171 X |

*Primary Examiner*—Sebastiano Passaniti
*Attorney, Agent, or Firm*—Bereskin & Parr

[57] ABSTRACT

This invention relates to a weighted golf club head having a generally flat front face for striking a ball and a body extending rearwardly from the front face. The body includes an attachment at one end for connecting to a golf club shaft and a toe at the other end. The head has a pair fixed internal weights extending behind the front face, the weights having a minor axis and a major axis. The major axis of the weight is generally transverse to the plane of the front face.

13 Claims, 2 Drawing Sheets

WEIGHTED GOLF CLUB HEAD

FIELD OF THE INVENTION

This invention relates to clubs and more particularly to the clubs used in the game of golf. More specifically, this invention relates to a type of golf club head which is weighted to enhance the performance of the dub when striking a golf ball.

The clubs used in the game of golf typically consist of three discrete classes. There are the woods, which are typically longer shafted clubs having a bulbous head and which are used for driving the ball off the tee or off the fairway. The woods most commonly used are referred to as the 1, 3 and 5 woods (although there are others such as 2, 4 and 7 woods) each of which has a slightly different shaft length, face inclination (loft) and weight of head. The number one wood is sometimes also referred to as a driver. A second class of golf clubs is typically referred to as the irons and would usually include a 1, 2, 3, 4, 5, 6, 7, 8, and 9 iron, and may also include pitching and sand wedges. A third class of club is the putter which is the club used exclusively on the greens to guide the golf ball into the cup.

In the past there have been many attempts to provide a golf club head design for woods and irons which maximizes control and accuracy while at the same time delivers distance and is easy to use. One way to provide such a golf club head design is to use a form of weighting in the head itself to alter the performance characteristics of the golf club head as it strikes the ball. There are many examples of weighted golf clubs in the prior art. More recently a form of weighting called perimeter weighting has become popular. Essentially, perimeter weighting is applied to irons and is accomplished by hollowing out the back face of the club to leave a greater thickness of metal around the outer perimeter of the golf club head. This increases the weight around the perimeter of the golf club and hence the term perimeter weighting. It is claimed that this improves the ease of hitting the ball.

A problem with the prior art devices, however, is that they still require that the golf ball be struck properly in order to propel the ball efficiently. Striking the ball properly requires contacting the ball with the club face at a very specific position and with the club face following a precise swing. Essentially, the ideal swing and position are required to hit the "sweet spot", which may be considered to be the contact point on the club face where no torque is imparted to the shaft of the club upon striking the ball. The "sweet spot" is that point on the club face where the forces at impact with the ball are balanced. The forces are made up of the momentum of the club head, together with a force component provided by the shaft of the club and the reactive force of the ball upon impact. Variances in swing can cause the actual impact point to be displaced from the ideal impact position. This makes hitting an ideal drive very difficult.

BRIEF SUMMARY OF THE INVENTION

What is desired is a golf club design which broadens the "sweet spot" so that upon striking the ball closer to the toe or closer to the heel, ie. somewhat off line, the club will still drive the ball in the direction of the swing rather than off to one side or the other as is the case presently for balls hit off line for conventional clubs.

According to the present invention there is provided:

A golf club head comprising: a main body having a front face for striking a ball, side top and bottom edges extending rearwardly from said front face, and an attachment for a shaft, said attachment being located on said main body generally behind said front face and towards one side edge; and a means for weighting said main body comprising at least two weights each having a major axis and a minor axis wherein the major axis is generally transverse to said front face and said minor axis is generally parallel to said front face, and wherein said weights are at least partially carried in projections extending from said main body.

According to another aspect of the present invention there is provided a golf club head comprising a main body, said main body having a concentration of weight generally towards each lateral side edge of said main body, and a reduction of weight towards the center of said main body, said concentration of weight comprising a pair of opposed weights having a major axis generally transverse to a face of said club and a minor axis generally parallel to said club face to form an enlarged sweet spot on the club head between said weights.

According to a further aspect of the present invention there is provided a golf club head comprising a main body having a front face, side edges and a pair of weights carried by said main body, said weights being symmetrically disposed in said main body about a vertical center-line of said club head and positioned laterally toward said side edges to generally optimize the mass moment of inertia of the club head about a vertical axis of rotation to optimize the resistance to angular acceleration about said vertical axis of rotation.

DETAILED DESCRIPTION OF THE DRAWINGS

To illustrate the invention and to show more clearly how it may be put into effect the following figures by way of illustration only disclose the preferred embodiment of the invention in which.

DETAILED DESCRIPTION OF THE PREFERRED EMBODIMENT

Figure 1:
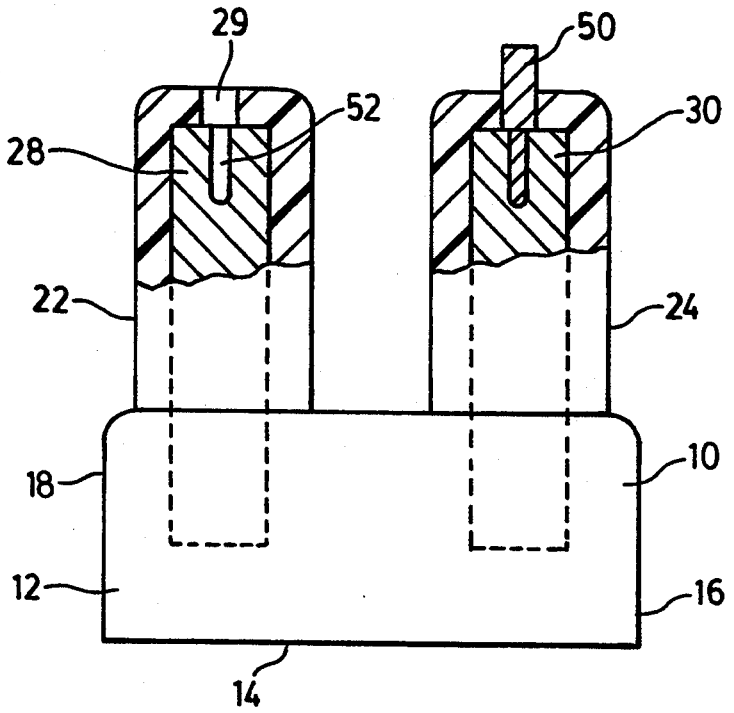
FIG. 1 is a bottom view in part section of an embodiment of the present invention.

A golf club head according to the present invention is indicated generally with reference numeral 10 in FIG. 1. The golf club head 10 includes a main body 12 having a front face 14 sides 16 and 18 and a top 20. Extending rearwardly from the main body are two weight retaining portions 22 and 24.

Figure 2:
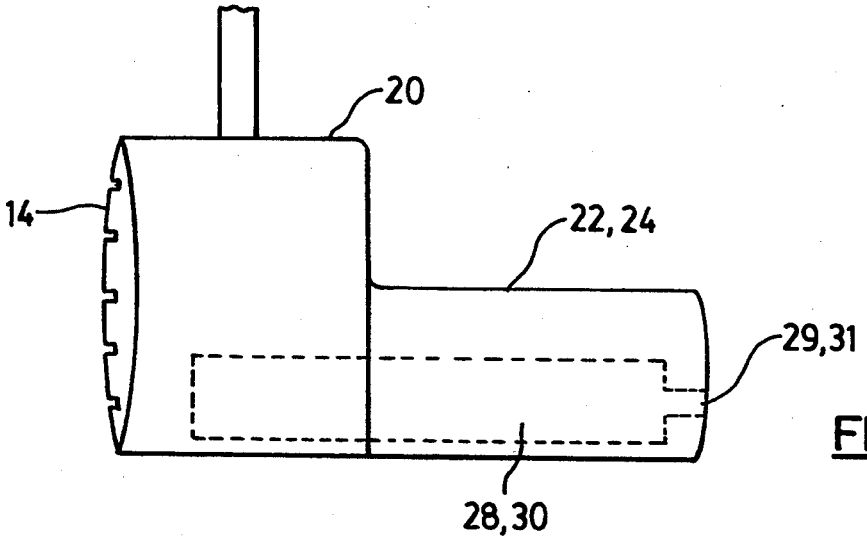
FIG. 2 is a side view of the invention of FIG. 1.

As can be seen in FIG. 2, the weight retaining portions 22 and 24 extend rearwardly preferably from the lower portion of the main body. Contained in a lower portion of the rearwardly extending portions are weights indicated in FIG. 2 as 28 and 30. The preferred form of the weights 28, 30 is steel bar, which may have a varying diameter depending on the weight needs of the particular club. As in conventional clubs the driver or number one club will have the lowest weight (and will attach to the longest shaft).

FIG. 1 shows in cutaway section the weight retaining portions 22 and 24 which show the weights 28 and 30. The preferred size of the weights range from about one ounce to two and a half ounces each, depending upon which number club the weights are to be installed in. Further the length of the weights will vary, with the driver having weights between 1 and ¼ inches to 2 and ¾ inches long with a preferred length being two inches long. The preferred weights are made from rod which is generally circular in cross section and which has a diameter which varies from ⅜ inches to 9/16 inches with the preferred diameters being 7/16 inches and ½ inches. For higher numbered clubs the length of the weight may be increased and the diameter may also be increased. For example a three wood is most preferred to have weights having a length of 2 and ½ inches and being formed of 7/16 inch diameter bar, while the weight for a five wood is most preferred to be 2 and ½ inches of ½ inch diameter bar. It is also preferred if the weights are made with all chamfered or rounded edges so as not to create an unnecessary stress concentration in the composite main body. The details of the preferred main body are described in more detail below.

Figure 3:
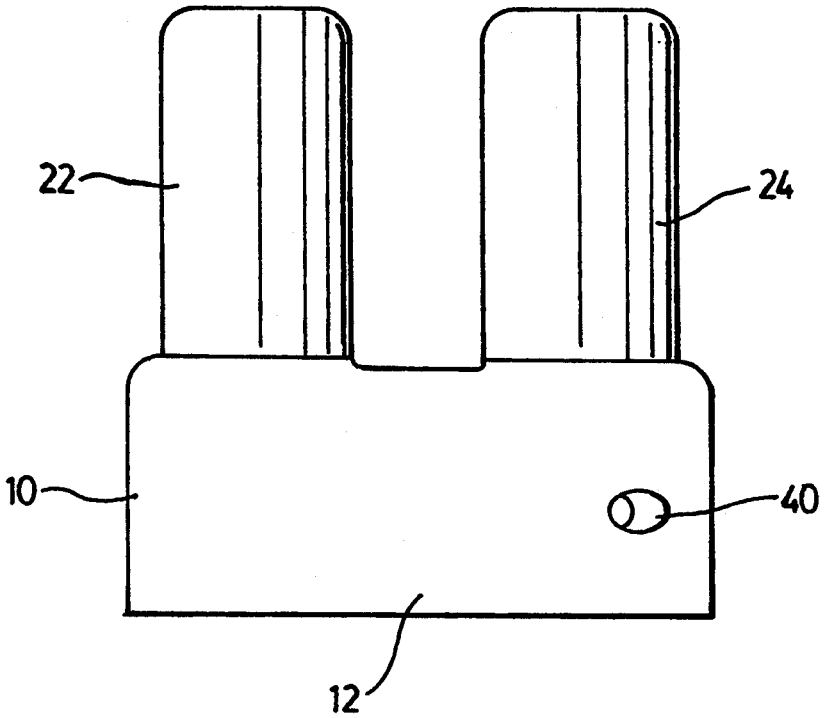
FIG. 3 is a top view of the invention of FIGS. 1 and 2.
Figure 4:
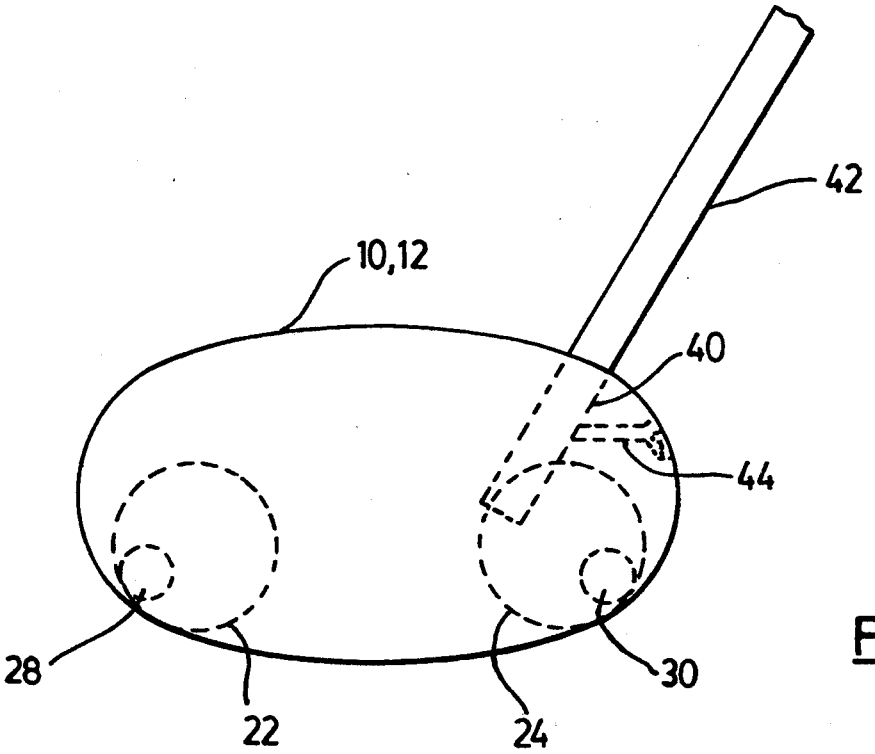
FIG. 4 is a front view of the invention of FIG. 1.

Turning to FIG. 3, an attachment means is shown which comprises a hole or bore 40 which may be formed in the main body for attachment of the club head 10 to a shaft 42 as shown in FIGS. 2 and 4. Satisfactory results have been achieved by merely using an adhesive, such as an epoxy resin, to fasten the shaft into the attachment bore 40. However, it may be desirable in certain circumstances to also us a small locking screw 44 which extends through the side of the main body into contact with the bore 40 as shown. This firmly fixes the shaft 42 into the main body 12 and prevents accidental and unwanted separation of the shaft 42 and the head 10.

The main body 12 is preferably formed from a one piece moulded material which is ideally a light weight but strong composite such as urethane or other rigid composite. The most preferred hardness of the main body 12 is about 70 on the D scale, although a range of hardness from 50to 90 on the D scale may also be appropriate. It will be appreciated by those skilled in the art that the moulded composite will be much less dense than metal or even most woods. Thus, the weighting of the main body can be designed to be located in specific positions to a greater extent than weights can with clubs formed from other denser material, since there is a limit on the absolute amount of weight that such a club may have. More specifically, individual weights can be positioned in the moulded body at specific optimum locations. Thus, the balance of the club becomes less a function of the shape of the club head and more the function of the designer's skill in placing the weights at the optimal position. As long as the composite is strong enough to carry the weights and does not fail upon repeated exposure to impact stresses it will likely be suitable. Satisfactory results have been achieved by using urethane, but other materials may also be suitable. Of particular note with the preferred composite is the feel of the club. In use it has been observed that the clubs formed according to the present invention create the impression of greater playability of the club over conventional clubs made from wood.

As noted above, the preferred form of manufacture of this type of club head is by moulding. However, in order to position the weights 28, 30 in the mould at the desired positions, a pin 50 is inserted into an opening 52 at the end of each weight, and then the pin 50 is held firmly in place while the moulding material is injected or poured into the mould all around the pin 50 and the weights 28, 30. Upon being cured, the plastic composite will tend to shrink slightly allowing the club head 10 to be removed easily from the mould. If necessary air can also be blown into the mould to facilitate removal. Once the moulded club head 10 is removed from the mould, the pins are removed. Thereafter, as will be appreciated by those skilled in the art, it may be desirable to cover the exit orifice 29, 31 with an additional bit of composite material.

The preferred composite material is quite workable and can be machined on a standard machining equipment to extremely close tolerances. Thus, a single mould could be used to produce a number of heads having different weights. Each head can then be individually machined into specific type of club having a particular club face loft, and groove configuration. Although club faces may be made convex, good results have been achieved by making the club face flat.

It will now be appreciated that there is no need to form a separate mould for each type of club being made. All that is required is to design the front to back thickness of the body, behind the club face, so that the angle of the club face (called loft) can be cut into the front face of the club. As described above, the club design of the present invention is not restricted to woods and can be also used to replace irons, provided an appropriate loft can be formed into the club face. It may be necessary to use a separate mould to produce clubs having very high lofts, however, at most two or three moulds will cover the complete range of clubs.

It is also a feature of the present invention that the width of the club be greater than the front to back dimension of the club. In order to achieve such dimensions and yet also achieve the rearward spacing of the weighting mass away from the center of the club face, a slightly wider club face is preferred than is conventional. This allows the weight retaining portions to extend further rearwardly which is desirable as explained below.

A club according to the present invention hits both very long and very true. It is believed that the extra distance is gained by increasing the proportion of the weight of the club at the lower or outermost end of the club. The greater the distance away from the center of rotation, the greater the centrifugal acceleration, provided the same velocity is reached. As the club is swung, this weight is accelerated and being at the lower end of the club, it is accelerated slightly more than if it were at the top of the club. This amounts to extra kinetic energy in the club head which can then be used upon striking the ball to propel the ball. This yields slightly longer results. The weight position towards the bottom of the club head also has the effect of lifting the ball when it is struck and allowing the ball to go up into the air increasing the playability of the club. Further, there is a small advantage of the club in resisting torsion impacts which might otherwise cause the club to twist about a horizontal axis.

It is believed that the club head of the present invention has a substantially greater "sweet spot" than in conventional clubs. In part this is due to the feel of the moulded composite, and in part it is due to the high resistance to angular acceleration as the club head strikes the ball. As discussed above hitting the "sweet spot" on a conventional club is a complex function of the type of swing, the club head weighting (ie the location of the center of gravity of the club) contact point between the ball and the club face and club shaft and club head dynamics. The present invention is configured to try to maximize the momentum of the club in the direction of the swing and hence in the direction in which the ball is struck. The present invention is also configured to provide a maximum resistance to twisting of the club head relative to the shaft upon impact. Such twisting is minimized by having a relatively high resistance to rotational acceleration which is obtained by spacing the weights generally to the opposite sides of the main body and generally lower in a plane below the surface of the ball. Thus the club hits very true by overcoming torsional twisting about the shaft (which otherwise occurs in a conventional club when the ball is not struck with a perfect swing perfectly at the center of the club face).

This can be understood by referring to the definition of the mass moment of inertia about an axis which is a measure of the resistance of a body to angular acceleration about that axis. The mass moment of inertia about the z axis, $I_z$, is calculated by using the equation:

$$I_z = \int_v r^2 dm;$$

where r=the distance to an elemental particle of mass; and dm=an elemental particle of mass. Thus, as will be appreciated, the mass moment of inertia about an axis z increases proportionally with the mass of an object and proportionally to the square of the distance the mass is located from the axis of rotation z. Thus, to increase rotational stability it is much more effective to increase the distance of the weight from the axis of rotation than it is to increase the weight.

In a convention club head with a relatively flexible shaft it is believed that the head will tend to twist slightly when the contact point is towards, for example, the toe. This twisting can result in a shot known to golfers as a slice, which causes the ball to spin and fly off line away from the golfer. With a club of the present invention, there is a greater resistance to such twisting, by reason of said weights being laterally displaced ( and therefore there is less tendency to slice) even if the club contact point with the ball is off towards the toe. The same is also true for balls hit towards the heel of the club which can result in a shot called a hook. It will be appreciated that by configuring the club head of the present invention to optimize the mass moment of inertia, as described above, a greater degree of control of the club face is achieved. It will also be appreciated that this optimization has two components. Specifically, the body is formed of a light weight composite material so that more of the total head weight can be preferentially located in the positionable weights, and secondly the weights are located as far as practical towards the sides and extending to the rear to maximize the distance from the front face of the club. According to the above equation maximizing the distance has a squared function effect and is thus the more significant of the two considerations.

Another feature of the preferred invention is that the rearward extensions of the club face tend to assist in guiding the club into a correct orientation just before striking the ball. In other words, if the player striking the ball is over-swinging so that the club face is inclined upwardly too much, the rearwardly extending portions of the main body will tend to contact the ground causing the club face to tip downwardly and make fuller and more driving contact with the ball during the swing. Thus the outward extensions of the main body have a beneficial effect in certain circumstances in aligning the club head onto the ball during the swing.

It will be appreciated by those skilled in the art that various modifications and alterations may be made from the above design without departing from the scope of the invention as defined by the appended claims. Some of these modifications have been suggested above and others will be apparent to those skilled in the art. For example, while the preferred weights and the rearwardly extending portions of the club head are both circular in cross section they could be any shape. Further, optimal results are achieved when the weights are placed outwardly, thus optimizing mass moment of inertia, although it is believed that reasonable results will also be achieved if the weights are located somewhat more towards the middle of the club face than shown in the drawings. Finally, the weights themselves could be formed from any type of material having the required strength and density.

I claim:

1. A golf club head comprising a main body, said main body having a concentration of weight generally towards each lateral side edge of said main body and a reduction of weight towards the center of said main body, said concentration of weight comprising opposed weights having a major axis generally transverse to a face of said club and a minor axis generally parallel to said club face to form an enlarged sweet spot on the club head generally between said weights, said main body being molded and having a thickness, said thickness being sufficient to permit one of a number of alternate club faces, each having a different loft, to be selectively carved from said thickness to form said front face, said weight concentration being achieved by forming a rearward extension on said body toward the lateral side edges, said extension carrying said weights and by restricting said body to said thickness between said extensions to form a generally C-shaped club head when viewed from above.

2. The golf club head of claim 1 wherein said main body is comprised of a composite material and said means for weighting comprises a denser material than the composite material.

3. The golf club head of claim 2 wherein said denser material is a metal, and said weights comprise rods having rounded edges.

4. The golf club head of claim 1 wherein said club face has a horizontal center line and said weights are located below the horizontal centerline of said head.

5. The golf club head of claim 4 wherein said club face has a vertical center line and said weights are located closer to said side edges than to said vertical center line.

6. The golf club head of claim 1 wherein said club head has a hardness rating of between 50 and 90 on the 'D' scale.

7. The golf club head of claim 6 wherein said club head has a hardness rating of about 70 on the 'D' scale.

8. The golf club head of claim 1 wherein the attachment for a shaft comprises a bore formed in said main body for receiving said shaft.

9. The golf club head of claim 8 wherein said attachment for a shaft further comprises a set screw which intersects said bore.

10. The golf club head of claim 3 wherein each of said weights are between one and two and a half ounces by weight.

11. The golf club head of claim 3 wherein each of said weights are between $\frac{5}{8}$ inches and 9/16 inches in diameter and between 1 and $\frac{3}{4}$ inches and 2 and $\frac{3}{4}$ inches long.

12. A golf club head as claimed in claim 1 wherein said club head is formed of a light weight composite so as to maximize the percentage of the total weight of the club provided by said weights to further optimize the mass moment of inertia of said club head.

13. A golf club comprising a golf club head as claimed in claim 1 and a shaft.

* * * * *